US007632396B2

(12) United States Patent
Feimer et al.

(10) Patent No.: US 7,632,396 B2
(45) Date of Patent: Dec. 15, 2009

(54) METHOD FOR REDUCING THE LEVEL OF ELEMENTAL SULFUR AND TOTAL SULFUR IN HYDROCARBON STREAMS

(75) Inventors: Joseph L. Feimer, Bright's Grove (CA); David J. LeClair, Sarnia (CA); Lawrence J. Lawlor, Camlachie (CA)

(73) Assignee: Exxonmobil Research and Engineering Company, Annandale, NJ (US)

( * ) Notice: Subject to any disclaimer, the term of this patent is extended or adjusted under 35 U.S.C. 154(b) by 581 days.

(21) Appl. No.: 11/123,517

(22) Filed: May 6, 2005

(65) Prior Publication Data

US 2006/0011516 A1 Jan. 19, 2006

Related U.S. Application Data

(60) Provisional application No. 60/587,918, filed on Jul. 14, 2004.

(51) Int. Cl.
*C10G 19/02* (2006.01)

(52) U.S. Cl. ..... 208/233; 208/208 R; 208/230; 208/232; 208/239; 208/231; 208/240

(58) Field of Classification Search ..... 208/233, 208/208 R, 230, 232, 239, 231, 240
See application file for complete search history.

(56) References Cited

U.S. PATENT DOCUMENTS

| | | | | |
|---|---|---|---|---|
| 2,460,227 | A | 1/1949 | Hart et al. | 196/30 |
| 3,185,641 | A | 5/1965 | Cowden | 208/226 |
| 4,011,882 | A | 3/1977 | Nivens et al. | 137/15 |
| 4,149,966 | A | 4/1979 | O'Donnell et al. | 208/237 |
| 5,160,045 | A | 11/1992 | Falkiner et al. | 210/634 |
| 5,199,978 | A | 4/1993 | Poirier et al. | 208/233 |
| 5,250,180 | A | 10/1993 | Chang | 210/375 |
| 5,250,181 | A | 10/1993 | Falkiner et al. | 210/634 |
| 5,525,233 | A | 6/1996 | Falkiner et al. | 210/638 |
| 5,618,408 | A | 4/1997 | Poirier et al. | 208/370 |
| 5,674,378 | A | 10/1997 | Kraemer et al. | 208/233 |

FOREIGN PATENT DOCUMENTS

| | | |
|---|---|---|
| CA | 1036054 | 8/1978 |

OTHER PUBLICATIONS

Gandhi, H.S., et al., "Effects of sulphur on noble metal automotive catalysts," *Applied Catalysis*, 77 (1991) 175-186, Elsevier Science Publishers B.V.

Gonzales, R.G., et al., "Can you make low-sulfur fuel and remain competitive?" *Hart's Fuel Technology & Management*, 56-61, Nov./Dec. 1996.

*Primary Examiner*—Tam M Nguyen
(74) *Attorney, Agent, or Firm*—Lawrence E. Carter

(57) ABSTRACT

A method for reducing the level of elemental sulfur from sulfur-containing hydrocarbon streams as well as reducing the level of total sulfur in such streams. Preferred hydrocarbon streams include fuel streams such as naphtha and distillate streams that are transported through a pipeline. The sulfur-containing hydrocarbon stream is blended with an aqueous solution of water, a caustic, and at least one metal sulfide thereby resulting in an organic phase and an aqueous phase. The blended stream is then passed through a bed of solids having a suitable surface area so that a substantial amount of the sulfur moieties are removed by the aqueous phase.

26 Claims, No Drawings

METHOD FOR REDUCING THE LEVEL OF ELEMENTAL SULFUR AND TOTAL SULFUR IN HYDROCARBON STREAMS

CROSS REFERENCE TO RELATED APPLICATION

This application claims benefit of U.S. Provisional Patent Application Ser. No. 60/587,918 dated Jul. 14, 2004.

FIELD OF THE INVENTION

This invention relates to a method for reducing the level of elemental sulfur from sulfur-containing hydrocarbon streams as well as reducing the level of total sulfur in such streams. Preferred hydrocarbon streams include fuel streams such as naphtha and distillate streams that are transported through a pipeline. The sulfur-containing hydrocarbon stream is blended with an aqueous solution of water, a caustic, and at least one metal sulfide thereby resulting in an organic phase and an aqueous phase. The blended stream is then passed through a bed of solids having a suitable surface area so that a substantial amount of the sulfur moieties are removed by the aqueous phase

BACKGROUND OF THE INVENTION

It is well known that elemental sulfur in hydrocarbon streams, such as petroleum streams, is corrosive and damaging to metal equipment. Elemental sulfur and sulfur compounds may be present in varying concentrations in refined petroleum streams, such as in gasoline boiling range streams. Additional contamination will typically take place as a consequence of transporting the refined stream through pipelines that contain sulfur contaminants remaining in the pipeline from the transportation of sour hydrocarbon streams, such as petroleum crudes. The sulfur also has a particularly corrosive effect on equipment, such as brass valves, gauges and in-tank fuel pump copper commutators.

Various techniques have been reported for removing elemental sulfur from petroleum streams. For example, U.S. Pat. No. 4,149,966 discloses a method for removing elemental sulfur from refined hydrocarbon fuel streams by adding an organo-mercaptan compound plus a copper compound capable of forming a soluble complex with the mercaptan and sulfur. The fuel is contacted with an adsorbent material to remove the resulting copper complex and substantially all the elemental sulfur.

U.S. Pat. No. 4,011,882 discloses a method for reducing sulfur contamination of refined hydrocarbon fluids transported in a pipeline for the transportation of sweet and sour hydrocarbon fluids by washing the pipeline with a wash solution containing a mixture of light and heavy amines, a corrosion inhibitor, a surfactant and an alkanol containing from 1 to 6 carbon atoms.

U.S. Pat. No. 5,618,408 teaches a method for reducing the amount of sulfur and other sulfur contaminants picked-up by refined hydrocarbon products, such as gasoline and distillate fuels, that are pipelined in a pipeline used to transport heavier sour hydrocarbon streams. The method involves controlling the level of dissolved oxygen in the refined hydrocarbon stream that is to be pipelined.

The removal of elemental sulfur from pipelined fuels is also addressed in U.S. Pat. No. 5,250,181 which teaches the use of an aqueous solution containing a caustic, an aliphatic mercaptan, and optionally a sulfide to produce an aqueous layer containing metal polysulfides and a clear fluid layer having a reduced elemental sulfur level. U.S. Pat. No. 5,199,978 teaches the use of an inorganic caustic material, an alkyl alcohol, and an organo mercaptan, or sulfide compound, capable of reacting with sulfur to form a fluid-insoluble polysulfide salt reaction product at ambient temperatures.

Also, U.S. Pat. No. 5,160,045 teaches that the addition of a sulphide to an alkali solution can remove elemental sulfur from hydrocarbon fluids and U.S. Pat. No. 5,250,180 teaches that the addition of an aliphatic mercaptan and a sulphide to an alkali solution can remove elemental sulfur from hydrocarbon fluids. U.S. Pat. No. 5,674,378 teaches the removal of sulfur from a pipelined petroleum stream by contacting the stream with an immiscible treatment comprising water or an immiscible alcohol, caustic, a sulfide or hydrosulfide, and optionally a mercaptan. These components are mixed in a co-current mixer.

U.S. Pat. No. 2,460,227 teaches that the addition of $Na_2S$ and an aromatic mercaptan at relatively high concentrations to an alkali solution can remove elemental sulfur from hydrocarbon fluids. However, none of these patents teach the reduction of total sulfur in the hydrocarbon stream while also reducing the elemental sulfur content. In fact, the addition of a sulfur containing species, such as a mercaptan, to the feed under certain conditions results in an increase in total sulfur in the product stream.

While such methods have met with varying degrees of success, there still exists a need in the art for a method capable of reducing the total sulfur content of a hydrocarbon stream while reducing the elemental sulfur content as well.

SUMMARY OF THE INVENTION

In accordance with the present invention there is provided a method for reducing both the level of elemental sulfur and total sulfur of a hydrocarbon stream containing same, which method comprises: a) mixing with said stream an aqueous solution comprised of water, a caustic, and at least one metal sulfide with sufficient mixing energy to result in a discontinuous aqueous phase dispersed in a continuous hydrocarbon phase; b) passing said mixture through a bed of solid particles having a sufficient surface area so that a substantial amount of elemental sulfur is transferred from the hydrocarbon phase to the aqueous phase; and c) separating said aqueous phase from the hydrocarbon phase that is substantially reduced in both elemental sulfur and total sulfur.

In a preferred embodiment, the solid particles are particles comprised of a material selected from the group consisting of silica-alumina (i.e., sand) alumina, alumina promoted with a metal, activated carbon, a zeolite, an ion exchange resin, and silica gel.

In another preferred embodiment, an aromatic mercaptan is present in a range from about 1 to about 1000 wppm.

In another preferred embodiment, the aromatic mercaptan is added to the hydrocarbon stream.

In yet another preferred embodiment, the aromatic mercaptan is added to the aqueous phase.

In another preferred embodiment of the present invention the hydrocarbon stream is a naphtha boiling range stream.

In yet another preferred embodiment of the present invention the hydrocarbon stream is a distillate boiling stream.

In still another preferred embodiment of the present invention the caustic is an inorganic caustic represented by the formula MOH where M is selected from the group consisting of lithium, sodium, potassium, $NH_4$, and mixtures thereof.

In another preferred embodiment of the present invention the sulfide is of a metal selected from Groups 1*a* and 2*a* of the Periodic Table of the Elements.

In yet other preferred embodiments of the present invention the aromatic mercaptan is selected from the group consisting of thiophenol, ethyl thiophenol, methyoxythiophenol, dimethylthiophenol, napthalenethiols, phenyl-di-mercapatan, and thiocresol.

DETAILED DESCRIPTION OF THE INVENTION

Hydrocarbon streams that are treated in accordance with the present invention are preferably petroleum refinery hydrocarbon streams containing elemental sulfur, particularly those naphtha and distillate streams wherein sulfur has been picked-up when the stream is transported through a pipeline. Preferred streams are also those wherein the elemental sulfur is detrimental to the performance of the intended use of the hydrocarbon stream. The more preferred streams to be treated in accordance with the present invention are naphtha boiling range streams that are also referred to as gasoline boiling range streams. Naphtha boiling range streams can comprise any one or more refinery streams boiling in the range from about 10° C. to about 230° C., at atmospheric pressure. Naphtha streams generally contain cracked naphtha that typically comprises fluid catalytic cracking unit naphtha (FCC catalytic naphtha, or cat cracked naphtha), coker naphtha, hydrocracker naphtha, resid hydrotreater naphtha, debutanized natural gasoline (DNG), and gasoline blending components from other sources from which a naphtha boiling range stream can be produced. FCC catalytic naphtha and coker naphtha are generally more olefinic naphthas since they are products of catalytic and/or thermal cracking reactions. Non-limiting examples of hydrocarbon feed streams boiling in the distillate range include diesel fuels, jet fuels, kerosene, heating oils, and lubes. Such streams typically have a boiling range from about 150° C. to about 600° C., preferably from about 175° C. to about 400° C. Dialkyl ether streams may also be treated in accordance with this invention. Alkyl ethers are typically used to improve the octane rating of gasoline. Such ethers are typically dialkyl ethers having 1 to 7 carbon atoms in each alkyl group. Illustrative ethers are methyl tertiary-butyl ether, methyl tertiary-amyl ether, methyl tertiary-hexyl ether, ethyl tertiary-butyl ether, n-propyl tertiary-butyl ether, and isopropyl tertiary-amyl ether. Mixtures of these ethers and hydrocarbon streams may also be treated in accordance with this invention.

The hydrocarbon streams treated herein can contain quantities of elemental sulfur as high as 1000 mg per liter, typically from about 10 to about 100 mg per liter, more typically from about 10 to 60 mg per liter, and most typically from about 10 to 30 mg per liter. Such streams can be effectively treated in accordance with this invention to reduce the elemental sulfur content to less than about 10 mg per liter, preferably to less than about 5 mg sulfur per liter, or lower.

The inorganic caustic material that is employed in the practice of this invention are those represented by the formula MOH wherein M is selected from the group consisting of lithium, sodium, potassium, $NH_4$, or mixtures thereof. M is preferably sodium or potassium, more preferably sodium.

The sulfide that is used in the practice of the present invention includes mono sulfides and polysulfides of metals from Groups 1a and 2a of the Periodic Table of the Elements, such as the one found in the inside front cover of the 55$^{th}$ edition of the *Handbook of Chemistry and Physics,* 1974-1975, CRC Press. Group 1a metals include Li, Na, and K; and Group 2a metals include Be, Mg, and Ca. Non-limiting examples of such sulfides include $Na_2S$, $Na_2S_4$, $K_2S$, $Li_2S$, NaHS, $(NH_4)_2S$, and the like. $Na_2S$ is preferred. The sulfide in caustic reacts with the elemental sulfur in the hydrocarbon stream to be treated to form polysulfides in caustic. Lower molecular weight polysulfides in caustic react with elemental sulfur to form higher molecular polysulfides. The sulfide may be present in a convenient source of caustic such as white liquor from paper pulp mills. Thus, the elemental sulfur moves from the hydrocarbon stream to the aqueous caustic phase.

Aromatic mercaptans can be employed in the practice of the present invention to improve performance. These mercaptans, in the presence of caustic, can form a sulfur complex that transfers easily into the fuel to react with the elemental sulfur, thereby accelerating sulfur removal from the hydrocarbon stream. The aromatic mercaptans that can be used in the practice of the present invention include a wide variety of compounds having the general formula RSH, where R represents an aromatic group. Non-limiting examples of such aromatic mercaptans include: thiophenol, ethyl thiophenol, methyoxythiophenol, dimethylthiophenol, napthalenethiols, phenyl-di-mercaptans, and thiocresol. Most preferred is thiophenol.

The proportion of water, caustic, sulfide and the optional aromatic mercaptan is an effective amount that will allow a predetermined quantity of elemental sulfur to react with the sulfide and be extracted from the hydrocarbon phase to the aqueous phase. This proportion may vary within wide limits. Typically, the aqueous treating solution contains caustic in the range of about 0.01 to 20M, with the sulfide concentration being from about 0.1 wt. % to about 30 wt. %, preferably 0.2 wt. % to 5 wt. %. The amount of aromatic mercaptan will be from about 1 wppm to about 1,000 wppm, preferably from about 1 wppm to about 100 wppm in either the caustic or hydrocarbon stream. The relative amount of aqueous treating solution containing caustic, metal sulfides, and optionally the aromatic mercaptan and the hydrocarbon stream to be treated may also vary within wide limits. Usually from about 1 to about 50,000 parts aqueous solution to one million parts hydrocarbon phase, preferably from about 100 parts to about 20,000 parts aqueous solution to one million parts hydrocarbon phase will be used.

The aqueous phase may be dispersed within the hydrocarbon stream by any suitable mixing device that will provide effective mixing. By "effective mixing" we mean that the mixing will provide enough energy to result in a discontinuous aqueous phase dispersed in the hydrocarbon phase. The discontinuous phase will be comprised of finely dispersed droplets of aqueous solution in the continuous hydrocarbon phase. Non-limiting examples of mixing devices include an in-line mixer, a dispersion device or a batch mixer as disclosed in U.S. Pat. No. 5,674,378 which is incorporated herein by reference.

The mixture is then passed through a bed of solid particles of effective size and composition to allow the passage of the mixture and to ensure enough surface area for the transfer of sulfur moieties from the organic phase to the aqueous phase. Non-limiting examples of such particles include alumina, alumina promoted with a metal, activated carbons, zeolites, ion exchange resins, and silica gels. The solids must provide enough surface area to allow elemental sulfur to be transferred from the hydrocarbon phase to the aqueous phase. It is believed that the aqueous phase coats the surface of the solids. The elemental sulfur in the hydrocarbon phase reacts at this coated-surface to form polysulfides that are then extracted to the aqueous phase.

Treating conditions that can be used in the practice of the present invention are effective conditions in the conventional range. That is, the contacting of the hydrocarbon stream to be treated is preferably effected at ambient temperature conditions, although higher temperatures up to about 200° C., or higher, may be used. Substantially atmospheric pressures are suitable, although higher pressures may, for example, range up to about 1,000 psig. Contact times may also vary widely depending on such things as the hydrocarbon stream to be treated, the amount of elemental sulfur therein, and the composition the treating solution. The contact time should be chosen to affect the desired degree of elemental sulfur conversion. The reaction proceeds relatively fast, usually within several minutes, depending on solution strengths and compositions. Contact times will range from about a few seconds to a few hours.

In general, the process of the present invention involves the addition to the hydrocarbon stream to be treated of a mixture of effective amounts of caustic, water, sulfide, and optionally an aromatic mercaptan. The mixture is then passed through the bed of solid particles to enhance the transfer of the sulfur moieties from the organic phase to the aqueous phase, and then allowed to settle so as to form an aqueous layer containing metal polysulfides and a clear hydrocarbon stream layer having a reduced level of both elemental sulfur and total sulfur. The treated hydrocarbon stream can be recovered by any suitable liquid/liquid separation technique, such as by decantation or distillation. The recovered aqueous layer may be recycled back to the mixing zone for contact with the hydrocarbon stream to be treated, or it may be discarded or used, for example, as a feedstock to pulping paper mills, such as those employing the Kraft pulp mill process.

The instant invention will typically be practiced by blending an immiscible water/alkali-metal/sulfide mixture with the elemental sulfur-containing hydrocarbon stream to be treated. An effective amount of aromatic mercaptan can be added to either the hydrocarbon phase or the aqueous phase for improved performance. As previously mentioned, the hydrocarbon and aqueous phases are blended in a mixing device, such as a co-current mixer, such that the immiscible aqueous solution constitutes the dispersed phase of the mixture and the hydrocarbon stream constitutes the continuous phase.

The sulfide concentration in the aqueous solution is from about 0.1 wt. % to about 30 wt. %, or as allowed by precipitation limits.

The following examples are illustrative of the invention and are not to be taken as limiting in any way.

EXAMPLE 1

A ¾" diameter by 3-foot long stainless steel (SS) vessel was packed with 200 cc of sand. A 100 mesh SS support screen was added to each end of the vessel to help contain the sand within the vessel. Gasoline was then pumped at 20 cc/min to the bottom of the packed bed while the vessel was operated at 20° C. The superficial velocity and residence time of the gasoline in the packed bed was 0.3 feet per minute (fpm) and 10 minutes, respectively. A sample of gasoline from the effluent of the packed bed was taken after 15 minutes to determine elemental sulfur by HPLC.

EXAMPLE 2

The packed bed of sand from Example 1 was flooded with 200 mls of an aqueous solution of 19 wt. % NaOH and then allowed to drain from the packed bed by gravity. The packed bed of sand was then flushed with approximately 3 liters of gasoline. After flushing the packed bed the gasoline was pumped at about 20 cc/min to the bottom of the packed bed while the vessel was operated at about 20° C. The superficial velocity and residence time of the gasoline in the packed bed was 0.3 fpm and 10 minutes, respectively. A sample of gasoline from the effluent of the packed bed was taken after 15 minutes to determine elemental sulfur by HPLC.

EXAMPLE 3

The packed bed of sand from Example 1 was flooded with 200 mls of an aqueous solution of 19 wt. % NaOH and 1.5 wt. % $Na_2S$ and then allowed to drain from the packed bed by gravity. The packed bed of sand was then flushed with approximately 3 liters of gasoline. After flushing the packed bed the gasoline was pumped at 20 cc/min to the bottom of the packed bed while the vessel was operated at about 20° C. The superficial velocity and residence time of the gasoline in the packed bed was 0.3 fpm and 10 minutes, respectively. A sample of gasoline from the effluent of the packed bed was taken after 15 minutes to determine the elemental sulfur by HPLC.

Table 1 below compares the effect of no aqueous solution, NaOH and NaOH/$Na_2S$ in an aqueous solution. Example 1 demonstrates that essentially no elemental sulfur is removed from gasoline by using only a packed bed of sand. Similarly, Example 2 demonstrates that essentially no elemental sulfur is removed from gasoline by using a packed bed of sand that was pre-conditioned with an aqueous solution of NaOH. Example 3 demonstrates that a packed bed of sand preconditioned with an aqueous solution containing both $Na_2S$ and NaOH is essentially to remove of elemental sulfur from gasoline.

TABLE 1

| Example | 1 | 2 | 3 |
|---|---|---|---|
| Packed Bed | Sand | Sand | Sand |
| Hydrocarbon Feed | Gasoline | Gasoline | Gasoline |
| Aqueous Solution | None | NaOH | NaOH/$Na_2S$ |
| Residence Time, min. | 10 | 10 | 10 |
| Superficial Velocity, fpm | 0.30 | 0.30 | 0.3 |
| Mixing Device | None | None | None |
| Mixing Energy, hp/kusgal | None | None | None |
| Feed Elemental Sulfur, mg/l | 16.1 | 16.1 | 17.0 |
| Product Elemental Sulfur, mg/l | 15.9 | 15.7 | 12.0 |
| Elemental Sulfur Removal, % | 1 | 2 | 29 |

EXAMPLE 4

A ¾" diameter by 3-foot long stainless steel (SS) vessel was packed with 200 cc (155 gms) of 14×28 mesh Alcan alumina AA400G. A 100 mesh SS support screen was added to each end of the vessel to help contain the alumina within the vessel. The packed bed of alumina was flooded with 200 mls of an aqueous solution of 19 wt. % NaOH and 1.5 wt. % $Na_2S$ and then allowed to drain from the packed bed by gravity. Gasoline was then pumped at 20 cc/min to the top of the packed bed while the vessel was operated at about 20° C. The superficial velocity and residence time of the gasoline in the packed bed was 0.3 fpm and 10 minutes, respectively. A sample of gasoline from the effluent of the packed bed was taken after 15 minutes to determine the elemental sulfur by HPLC.

EXAMPLE 5

The packed bed of alumina from Example 1 was flushed with 2.4 litters of gasoline. An aqueous solution of 19 wt. % NaOH and 1.5 wt. % $Na_2S$ was pumped at 0.2 cc/min while gasoline was pumped at 20 cc/min to a mixing "T". The mixing energy through the mixing "T" was negligible. The mixture of aqueous solution and gasoline (1 vol. % aqueous solution-to-gasoline) then flowed to the top of the packed bed. The packed bed of alumina was operated at about 20° C. The superficial velocity and residence time of the gasoline in the packed bed was 0.3 fpm and 10 minutes, respectively. A sample of gasoline from the effluent of the packed bed was taken after 15 minutes to determine the elemental sulfur by HPLC.

EXAMPLE 6

An aqueous solution of 19 wt. % NaOH and 1.5 wt. % $Na_2S$ was pumped at 0.2 cc/min while gasoline was pumped at 20 cc/min to an in-line mixer filled with ten 150 mesh SS screens. The pressure drop across the in-line screen mixer was about 1 psi. The mixing energy through the in-line screen mixer was about 1 hp/kusgal. The mixture of aqueous solution and gasoline (1 vol. % aqueous solution-to-gasoline) then flowed to the top of the packed bed from Example 2. The packed bed of alumina was operated at about 20° C. The superficial velocity and residence time of the gasoline in the packed bed was 0.3 fpm and 10 minutes, respectively. A sample of gasoline from the effluent of the packed bed was taken after 30 minutes to determine the elemental sulfur by HPLC.

Table 2 below compares the effect of flooding the bed with an aqueous solution and a continuously adding a 1% aqueous solution-to-gasoline ratio to the packed bed. Example 4 demonstrates that very little elemental sulfur is removed when the packed bed is flooded with the aqueous solution. On the other hand, Example 5 demonstrates a significantly improvement in the packed bed performance when the aqueous solution-to-hydrocarbon ratio is only 1% (the elemental sulfur removal increased from 5 to 67%).

Table 2 also compares the effect of mixing energy on the ability of the packed bed to remove elemental sulfur. The mixing "T" provides no mixing energy while the in-line mesh mixer is better able to disperse the aqueous solution into the continuous gasoline phase. Example 6 demonstrates that increasing the mixing energy to obtain a more dispersed aqueous solution increases the elemental sulfur removal (i.e., 67% for Example 5 to 77% for Example 6).

TABLE 2

| Example | 4 | 5 | 6 |
|---|---|---|---|
| Packed Bed | Alumina | Alumina | Alumina |
| Hydrocarbon Feed | Gasoline | Gasoline | Gasoline |
| Aqueous Solution | $NaOH/Na_2S$ | $NaOH/Na_2S$ | $NaOH/Na_2S$ |
| Aqueous Solution-to-Gasoline Ratio, vol. % | Flooded | 1% | 1% |
| Residence Time, min. | 10 | 10 | 10 |
| Superficial Velocity, fpm | 0.30 | 0.30 | 0.3 |
| Mixing Device | None | Mixing "T" | In-line (10 × 150 mesh) |
| Mixing Energy, hp/kusgal | Negligible | Negligible | ~1 |
| Feed Elemental Sulfur, mg/l | 21.8 | 25.2 | 24.4 |
| Product Elemental Sulfur, mg/l | 20.7 | 8.4 | 5.6 |
| Elemental Sulfur Removal, % | 5 | 67 | 77 |

EXAMPLE 7

An aqueous solution of 19 wt. % NaOH and 1.5 wt. % $Na_2S$ was pumped at 0.2 cc/min while gasoline was pumped at 10 cc/min to an in-line mixer filled with ten 150 mesh SS screens. The pressure drop across the in-line screen mixer was about 1 psi. The mixing energy through the in-line screen mixer was about 1 hp/kusgal. The mixture of aqueous solution and gasoline (2 vol. % aqueous solution-to-gasoline) then flowed to the top of the packed bed from Example 3. The packed bed of alumina was operated at about 20° C. The superficial velocity and residence time of the gasoline in the packed bed was 0.15 fpm and 20 minutes, respectively. A sample of gasoline from the effluent of the packed bed was taken after 30 minutes to determine the elemental sulfur by HPLC.

EXAMPLE 8

An aqueous solution of 19 wt. % NaOH and 1.5 wt. % $Na_2S$ was pumped at 0.24 cc/min while gasoline was pumped at 4.5 cc/min to an in-line mixer filled with ten 150 mesh SS screens. The pressure drop across the in-line screen mixer was about 1 psi. The mixing energy through the in-line screen mixer was about 1 hp/kusgal. The mixture of aqueous solution and gasoline (5 vol. % aqueous solution-to-gasoline) then flowed to the top of the packed bed from Example 4. The packed bed of alumina was operated at about 20° C. The superficial velocity and residence time of the gasoline in the packed bed was 0.08 fpm and 40 minutes, respectively. A sample of gasoline from the effluent of the packed bed was taken after 30 minutes to determine the elemental sulfur by HPLC.

EXAMPLE 9

A ¾" diameter by 3-foot long stainless steel (SS) vessel was packed with 200 cc (155 gms) of 14×28 mesh Alcan alumina AA400G. A 100 mesh SS support screen was added to each end of the vessel to help contain the alumina within the vessel. The packed bed of alumina was flooded with 200 mls of an aqueous solution of 19 wt. % NaOH and 1.5 wt. % $Na_2S$ and then allowed to drain from the packed bed by gravity. The packed bed of alumina was then flushed with 2.4 liters of gasoline.

An aqueous solution of 19 wt. % NaOH and 1.5 wt. % $Na_2S$ was pumped at 0.04 cc/min while gasoline was pumped at 20 cc/min to an in-line mixer filled with ten 150 mesh SS screens. The pressure drop across the in-line screen mixer was about 1 psi. The mixing energy through the in-line screen mixer was about 1 hp/kusgal. The mixture of aqueous solution and gasoline (0.2 vol. % aqueous solution-to-gasoline) then flowed to the top of the packed bed. The packed bed of alumina was operated at about 20° C. The superficial velocity and residence time of the gasoline in the packed bed was 0.30 fpm and 10 minutes, respectively. A sample of gasoline from the effluent of the packed bed was taken after 30 minutes to determine the elemental sulfur by HPLC.

Table 3 compares the effect of the aqueous solution-to-gasoline ratio on the packed bed performance. Example 7 demonstrates excellent elemental sulfur removal with the packed when the aqueous solution-to-gasoline ratio to the packed bed is 2% and the residence time of the hydrocarbon in the packed bed is 20 minutes. Example 8 demonstrates that the packed bed performance deteriorates significantly when the aqueous solution-to gasoline ratio is increased to 5%. Example 9 demonstrates that high elemental sulfur performance can still be achieved with a packed bed at aqueous solution to gasoline ratios as low as 0.2%.

TABLE 3

| Example | 7 | 8 | 9 |
|---|---|---|---|
| Packed Bed | Alumina | Alumina | Alumina |
| Hydrocarbon Feed | Gasoline | Gasoline | Gasoline |
| Aqueous Solution | $NaOH/Na_2S$ | $NaOH/Na_2S$ | $NaOH/Na_2S$ |
| Aqueous solution-to-Hydrocarbon Ratio, vol. | 2% | 5% | 0.2% |
| Residence Time, min. | 20 | 40 | 10 |
| Superficial Velocity, fpm | 0.15 | 0.08 | 0.30 |
| Mixing Device | In-line (10 × 150 mesh) | In-line (10 × 150 mesh) | In-line (10 × 150 mesh) |
| Mixing Energy, hp/kusgal | ~1 | ~1 | ~1 |
| Feed Elemental Sulfur, mg/l | 24.5 | 24.5 | 24.4 |
| Product Elemental Sulfur, mg/l | 1.0 | 14.6 | 1.6 |
| Elemental Sulfur Removal, % | 96 | 40 | 93 |

EXAMPLE 10

A ¾" diameter by 3-foot long stainless steel (SS) vessel was packed with 200 cc (155 gms) of 14×28 mesh Alcan alumina AA400G. A 100 mesh SS support screen was added to each end of the vessel to help contain the alumina within the vessel. The packed bed of alumina was flooded with 200 mls of an aqueous solution of 19 wt. % NaOH and 1.5 wt. % $Na_2S$ and then allowed to drain from the packed bed by gravity. The packed bed of alumina was then flushed with 2.4 liters of diesel.

An aqueous solution of 19 wt. % NaOH and 1.5 wt. % $Na_2S$ was pumped at 0.04 cc/min while diesel was pumped at 18 cc/min to an in-line mixer filled with ten 150 mesh SS screens. The pressure drop across the in-line screen mixer was about 1 psi. The mixing energy through the in-line screen mixer was about 1 hp/kusgal. The mixture of aqueous solution and diesel (0.2 vol. % aqueous solution-to-diesel) then flowed to the top of the packed bed. The packed bed of alumina was operated at about 20° C. The superficial velocity and residence time of the diesel in the packed bed was 0.33 fpm and 9 minutes, respectively. A sample of diesel from the effluent of the packed bed was taken after 30 minutes to determine the elemental sulfur by a polarograph.

EXAMPLE 11

An aqueous solution of 19 wt. % NaOH and 1.5 wt. % $Na_2S$ was pumped at 0.05 cc/min while diesel was pumped at 10 cc/min to an in-line mixer filled with ten 150 mesh SS screens. The pressure drop across the in-line screen mixer was about 1 psi. The mixing energy through the in-line screen mixer was about 1 hp/kusgal. The mixture of aqueous solution and gasoline (0.5 vol. % aqueous solution-to-diesel) then flowed to the top of the packed bed from Example 7. The packed bed of alumina was operated at about 20° C. The superficial velocity and residence time of the diesel in the packed bed was 0.15 fpm and 20 minutes, respectively. A sample of diesel from the effluent of the packed bed was taken after 30 minutes to determine the elemental sulfur by a polarograph.

EXAMPLE 12

A ¾" diameter by 3-foot long stainless steel (SS) vessel was packed with 200 cc (155 gms) of 14×28 mesh Alcan alumina AA400G. A 100 mesh SS support screen was added to each end of the vessel to help contain the alumina within the vessel. The packed bed of alumina was flooded with 200 mls of an aqueous solution of 19 wt. % KOH and 1.5 wt. % $Na_2S$ and then allowed to drain from the packed bed by gravity. The packed bed of alumina was then flushed with 2.4 liters of diesel.

An aqueous solution of 19 wt. % KOH and 1.5 wt. % $Na_2S$ was pumped at 0.05 cc/min while diesel was pumped at 10 cc/min to an in-line mixer filled with ten 150 mesh SS screens. The pressure drop across the in-line screen mixer was about 1 psi. The mixing energy through the in-line screen mixer was 1 hp/kusgal. The mixture of aqueous solution and diesel (0.5 vol. % aqueous solution-to-diesel) then flowed to the top of the packed bed. The packed bed of alumina was operated at about 20° C. The superficial velocity and residence time of the diesel in the packed bed was 0.16 fpm and 20 minutes, respectively. A sample of diesel from the effluent of the packed bed was taken after 30 minutes to determine the elemental sulfur by a polarograph.

EXAMPLE 13

A ¾" diameter by 3-foot long stainless steel (SS) vessel was packed with 200 cc (155 gms) of 14×28 mesh Alcan alumina AA400G. A 100 mesh SS support screen was added to each end of the vessel to help contain the alumina within the vessel. The packed bed of alumina was flooded with 200 mls of an aqueous solution of 19 wt. % NaOH and 1.5 wt. % $Na_2S$ and then allowed to drain from the packed bed by gravity. The packed bed of alumina was then flushed with 2.4 liters of diesel.

An aqueous solution of 19 wt. % NaOH and 1.5 wt. % $Na_2S$ was pumped at 0.05 cc/min while diesel was pumped at 10 cc/min to a 4"×4" batch mixer operated at 1000 rpm. The mixing energy through the in-line screen mixer was 30 hp/kusgal. The mixture of aqueous solution and diesel (0.5 vol. % aqueous solution-to-diesel) then flowed to the top of the packed bed. The packed bed of alumina was operated at ~20° C. The superficial velocity and residence time of the diesel in the packed bed was 0.16 fpm and 20 minutes, respectively. A sample of diesel from the effluent of the packed bed was taken after 30 minutes to determine the elemental sulfur by a polarograph.

Table 4 compares the packed bed performance with a diesel hydrocarbon stream. Examples 10 and 11 demonstrate that a diesel hydrocarbon stream is significantly more difficult to treat than a gasoline hydrocarbon stream. Example 12 demonstrates that the using KOH instead of NaOH in the aqueous solution can improve the performance of the packed bed. Example 13 demonstrates that increasing the mixing energy to produce a better dispersion significantly improves the ability of the packed bed to remove elemental sulfur.

TABLE 4

| Example | 10 | 11 | 12 | 13 |
|---|---|---|---|---|
| Packed Bed | Alumina | Alumina | Alumina | Alumina |
| Hydrocarbon Feed | Diesel | Diesel | Diesel | Diesel |
| Aqueous Solution | $NaOH/Na_2S$ | $NaOH/Na_2S$ | $KOH/Na_2S$ | $NaOH/Na_2S$ |
| Aqueous solution-to-Hydrocarbon Ratio, vol. % | 0.2% | 0.5% | 0.5% | 0.5% |
| Residence Time, min. | 9 | 20 | 20 | 20 |
| Superficial Velocity, fpm | 0.33 | 0.15 | 0.16 | 0.16 |
| Mixing Device | In-line (10 × 150 mesh) | In-line (10 × 150 mesh) | In-line (10 × 150 mesh) | Batch (1000 rpm) |
| Mixing Energy, hp/kusgal | ~1 | ~1 | ~1 | 30 |

TABLE 4-continued

| Example | 10 | 11 | 12 | 13 |
|---|---|---|---|---|
| Feed Elemental Sulfur, mg/l | 18.1 | 17.9 | 16.8 | 16.9 |
| Product Elemental Sulfur, mg/l | 18.2 | 16.4 | 14.2 | 0.7 |
| Elemental Sulfur Removal, % | 0 | 8 | 15 | 96 |

The invention claimed is:

1. A method for reducing both the level of elemental sulfur and total sulfur of a hydrocarbon stream containing same, which method comprises:

(a) adding to said stream, water, a caustic, and at least one metal sulfide, thereby resulting in a mixture of hydrocarbon phase and aqueous phase, wherein said mixture is used in an effective amount and under effective conditions so that at least a portion of the elemental sulfur reacts with said at least one metal sulfide to form the corresponding metal polysulfide that is soluble in the aqueous phase;

(b) passing said mixture through a bed of solid particles having a sufficient surface area so that a substantial amount of metal polysulfide is transferred from the hydrocarbon phase to the aqueous phase; and (c) separating said aqueous phase containing said metal polysulfide component, from the hydrocarbon phase that is substantially reduced in both elemental sulfur and total sulfur.

2. The method of claim 1 wherein the hydrocarbon stream is a naphtha boiling range stream.

3. The method of claim 1 wherein the solid particles are comprised of a material selected from the group consisting of alumina, alumina promoted with a metal, activated carbons, zeolites, ion exchange resins, and silica gels.

4. The method of claim 1 wherein the caustic is represented by the formula MOH where M is selected from the group consisting of lithium, sodium, potassium, and $NH_4$.

5. The method of claim 4 wherein the caustic is used in the range of about 0.01 to 20 molar.

6. The method of claim 1 wherein the metal of the sulfide is of a metal selected from Groups 1a and 2a of the Periodic Table of the Elements.

7. The method of claim 6 wherein the sulfide is selected from the group consisting of $Na_2S$, $Na_2S_4$, $K_2S$, $Li_2S$, NaHS, $(NH_4)_2S$, and mixtures thereof.

8. The method of claim 6 wherein the sulfide is used in range of about 0.1 wt. % to about 5 wt. %.

9. The method of claim 1 wherein an aromatic mercaptan is added to the hydrocarbon stream in step a).

10. The method of claim 9 wherein the aromatic mercaptan is selected from the group consisting of thiophenol, ethyl thiophenol, methyoxythiophenol, dimethylthiophenol, naphtalenethiols, phenyl-di-mercapatan, and thiocresol.

11. The method of claim 9 wherein the aromatic mercaptan is present in a range from about 1 to about 1000 wppm.

12. The method of claim 9 wherein the aromatic mercaptan is added to the aqueous phase.

13. The method of claim 1 wherein the aqueous phase is from about 0.05 to about 10 times the volume of the hydrocarbon phase.

14. The method of claim 13 wherein the aqueous phase is from about 0.1 to about 10 times the volume of the hydrocarbon phase.

15. A method for reducing both the level of elemental sulfur and total sulfur of a hydrocarbon stream containing same, which method comprises:

(a) adding to said stream, water, a caustic represented by the formula MOH where M is selected from the group consisting of lithium, sodium, potassium, and $NH_4$, at least one metal sulfide of a metal selected from Groups 1a and 2a of the Periodic Table of the Elements, thereby resulting in a mixture of a hydrocarbon phase and an aqueous phase, wherein said mixture is used in an effective amount and under effective conditions so that at least a portion of the elemental sulfur reacts with said at least one metal sulfide to form the corresponding metal polysulfide that is soluble in the aqueous phase;

(b) passing said mixture through a bed of solid particles having a sufficient surface area so that a substantial amount of metal polysulfide is transferred from the hydrocarbon phase to the aqueous phase; and (c) separating said aqueous phase containing said metal polysulfide component, and said hydrocarbon phase that is substantially reduced in both elemental sulfur and total sulfur.

16. The method of claim 15 wherein the hydrocarbon stream is a naphtha boiling range stream.

17. The method of claim 15 wherein the solid particles are comprised of a material selected from the group consisting of alumina, alumina promoted with a metal, activated carbons, zeolites, ion exchange resins, and silica gels.

18. The method of claim 15 wherein the caustic is used in the range of about 0.01 to 20 molar.

19. The method of claim 15 wherein the sulfide is selected from the group consisting of $Na_2S$, $Na_2S_4$, $K_2S$, $Li_2S$, NaHS, $(NH_4)_2S$, and mixtures thereof.

20. The method of claim 19 wherein the sulfide is used in range of about 0.1 wt. % to about 5 wt. %.

21. The method of claim 15 wherein an aromatic mercaptan is present and is selected from the group consisting of thiophenol, ethyl thiophenol, methyoxythiophenol, dimethylthiophenol, naphtalenethiols, phenyl-di-mercapatan, and thiocresol.

22. The method of claim 15 wherein an aromatic mercaptan is added to the hydrocarbon stream in step a).

23. The method of claim 22 wherein the aromatic mercaptan is present in a range from about 1 to about 1000 wppm.

24. The method of 15 wherein an aromatic mercaptan is added to the aqueous phase.

25. The method of claim 15 wherein the aqueous phase is from about 0.05 to about 10 times the volume of the hydrocarbon phase.

26. The method of claim 25 wherein the aqueous phase is from about 0.1 to about 10 times the volume of the hydrocarbon phase.

* * * * *